US006390238B1

(12) United States Patent
Gibson et al.

(10) Patent No.: US 6,390,238 B1
(45) Date of Patent: May 21, 2002

(54) FOLDABLE STEP STOOL WITH LEG LOCK AND HANDLE

(75) Inventors: William R. Gibson, Kent, OH (US); Enrique R. Giner; Maria Antonieta Moreno-Giner, both of Huntington Woods, MI (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/636,440

(22) Filed: Aug. 11, 2000

Related U.S. Application Data

(60) Provisional application No. 60/149,370, filed on Aug. 13, 1999.

(51) Int. Cl.[7] ..... E06C 1/00

(52) U.S. Cl. ..... 182/161; 182/129; 182/165; 280/642

(58) Field of Search ..... 182/161, 162, 182/163, 164, 165, 129, 104, 156, 127, 20; 280/642, 47.36

(56) References Cited

U.S. PATENT DOCUMENTS

| | | | | |
|---|---|---|---|---|
| 1,557,490 | A | | 10/1925 | Videtta |
| 1,817,233 | A | | 8/1931 | Bumgardner |
| 2,776,856 | A | | 11/1957 | Ingram |
| 2,873,995 | A | | 2/1959 | Turner |
| 2,908,362 | A | | 10/1959 | Burtchaell |
| 2,967,730 | A | | 1/1961 | Vann |
| 2,997,326 | A | | 8/1961 | Daum |
| 3,718,242 | A | | 2/1973 | Larson |
| 3,892,343 | A | | 7/1975 | Warner |
| 4,483,415 | A | | 11/1984 | Disston et al. |
| 4,485,892 | A | * | 12/1984 | Maloney et al. ..... 182/161 |
| 4,707,883 | A | | 11/1987 | Irani et al. |
| 4,733,882 | A | * | 3/1988 | Kassai ..... 280/47.37 R |
| 4,842,315 | A | | 6/1989 | Nordmeyer |
| 5,161,843 | A | | 11/1992 | Baldwin |
| 5,210,904 | A | | 5/1993 | Pratt |
| 5,232,796 | A | | 8/1993 | Baumgartner |
| 5,511,285 | A | | 4/1996 | Bush et al. |
| 5,762,163 | A | * | 6/1998 | Kain ..... 182/161 |
| 5,823,564 | A | * | 10/1998 | Kettler ..... 280/642 |
| 5,937,968 | A | * | 8/1999 | Gibson et al. ..... 182/165 |
| 5,979,928 | A | * | 11/1999 | Kuo ..... 280/642 |
| 6,000,497 | A | * | 12/1999 | Kain et al. ..... 182/129 |
| 6,026,933 | A | * | 2/2000 | King et al. ..... 182/165 |
| 6,039,149 | A | * | 3/2000 | Bedja ..... 182/20 |
| 6,062,587 | A | * | 5/2000 | Cabagnero ..... 280/642 |
| 6,073,945 | A | * | 6/2000 | Cheng ..... 280/47.36 |
| 6,073,957 | A | * | 6/2000 | Lan ..... 280/642 |
| 6,155,740 | A | * | 12/2000 | Hartenstine ..... 403/102 |

* cited by examiner

*Primary Examiner*—Bruce A. Lev
(74) *Attorney, Agent, or Firm*—Barnes & Thornburg

(57) ABSTRACT

A step stool includes a frame including a front leg and a rear leg coupled to the front leg for movement relative to the front leg, a handle supported for pivotable movement on the front leg about a pivot axis, and a retainer coupled to the handle to move therewith about the pivot axis and arranged to trap a portion of the rear leg between the handle and the retainer upon movement of the handle to a predetermined position relative to the rear leg to lock the front leg to the rear leg.

31 Claims, 5 Drawing Sheets

FOLDABLE STEP STOOL WITH LEG LOCK AND HANDLE

This claims priority under 35 U.S.C. §119(e) to U.S. Provisional Application Ser. No. 60/149,370, filed Aug. 13, 1999, which is expressly incorporated by reference herein.

BACKGROUND AND SUMMARY OF THE INVENTION

The present invention relates to a step stool, and particularly, to a foldable step stool having legs that move relative to one another between an opened use position and a closed storage position. More particularly, the present invention relates to a foldable step stool provided with a carrying handle for use when the step stool has been folded to assume the closed storage position.

Step stools have a frame and one or more steps that individuals use for elevation when reaching for objects, painting walls, or any everyday task where extra elevation would be helpful. Step stool frames are often foldable for ease of storage while the step stool is not being used.

According to the present invention, a foldable step stool includes a frame having a front leg and a rear leg movable relative to the front leg and a carrying handle supported for pivotable movement on one of the legs about a pivot axis. The step stool further includes a retainer coupled to the handle to move with the handle about the pivot axis to lock the front leg to the rear leg.

In preferred embodiments, the handle includes a pivot rod supported on the front leg for rotation about the pivot axis and a handle grip coupled to the pivot rod. A handle anchor is coupled to the rear leg and formed to include a pair of rod jackets positioned to lie in spaced-apart relation to one another and mate with the pivot rod of the handle when the rear leg is moved to lie alongside the front leg whenever the foldable step stool is collapsed for storage.

The retainer includes a pair of retainer members and each retainer member is coupled to the handle grip. Each retainer member is arranged to trap one of the rod jackets in a fixed position adjacent to the pivot rod after the foldable step stool has been collapsed to mate the rod jackets of the handle anchor with the pivot rod of the handle and the handle is pivoted about the pivot axis to assume a stool-carrying position.

A handle mount is coupled to the front leg and arranged to support the pivot rod of the handle for rotation about the pivot axis. The handle anchor further includes a jacket support coupled to the rear leg and arranged to support the two rod jackets in spaced-apart relation to one another so that they mate with the pivot rod in a position to be trapped by the retainer members during pivoting of the handle about the pivot axis to lock the front and rear legs together.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 1 is a front perspective view of a step stool in the opened use position showing, on the right side of the step stool, a handle anchor coupled to an edge of the rear leg and a carrier lock, with portions broken away, coupled to an edge of the front leg;

FIG. 2 is a front view of the step stool of FIG. 1;

FIG. 3 is a rear view of the step stool of FIGS. 1 and 2;

FIG. 4 is a side view of the step stool of FIGS. 1–3 showing the handle anchor coupled to the rear leg and the carrier lock coupled to the front leg;

DETAILED DESCRIPTION OF THE DRAWINGS

Figure 7:
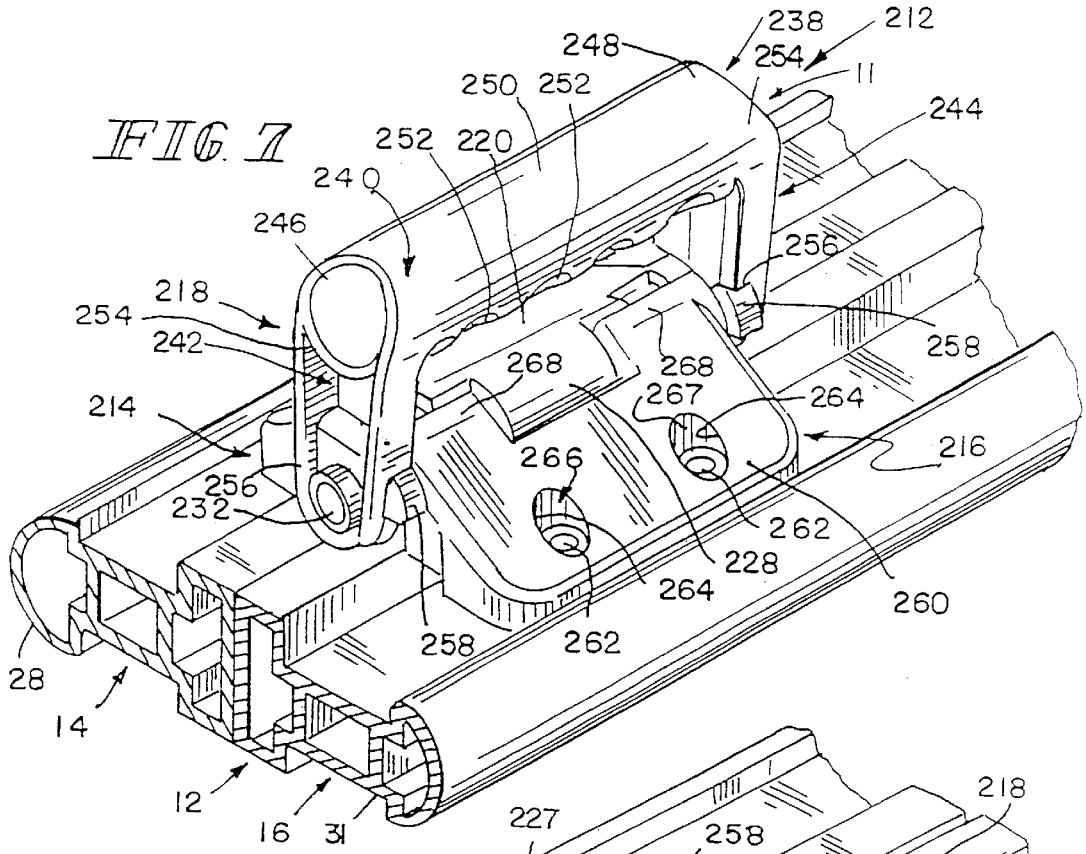
FIG. 7 is a view similar to FIGS. 5 and 6 showing movement of the handle to assume a stool-carrying position wherein the quarter-round retainer members on the handle trap the rod jackets between the retainer members and the pivot rod to retain the rear leg in a fixed position alongside the front leg.
Figure 8:
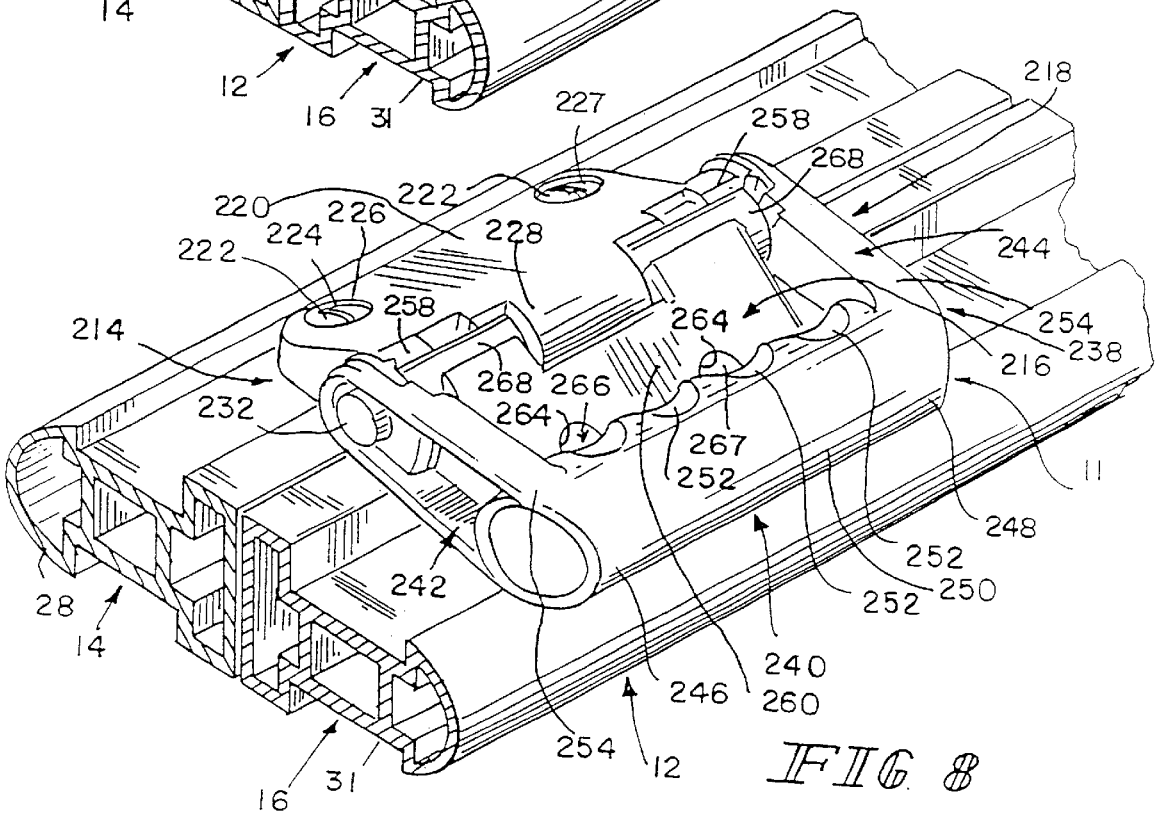
FIG. 8 is a view similar to FIGS. 5–7 showing continued rotation of the handle grip about its axis of rotation to assume a leg-locking "storage" position.

A foldable step stool 10 (shown, for example, in FIGS. 1–4) includes a carrier lock 11 that is configured to lock front and rear legs 14, 16 of step stool 10 together to retain rear leg 16 in a fixed position alongside front leg 14 as shown, for example, in FIGS. 7 and 8. Carrier lock 11 is coupled to an edge of front leg 14 as shown, for example, in FIGS. 1, 4, and 5. A handle anchor 13 adapted to mate with carrier lock 11 is coupled to an edge of front leg 14 also as shown, for example, in FIGS. 1, 4, and 5. Locking rear leg 16 to front leg 14 facilitates transport and storage of folded step stool 10.

Figure 5:
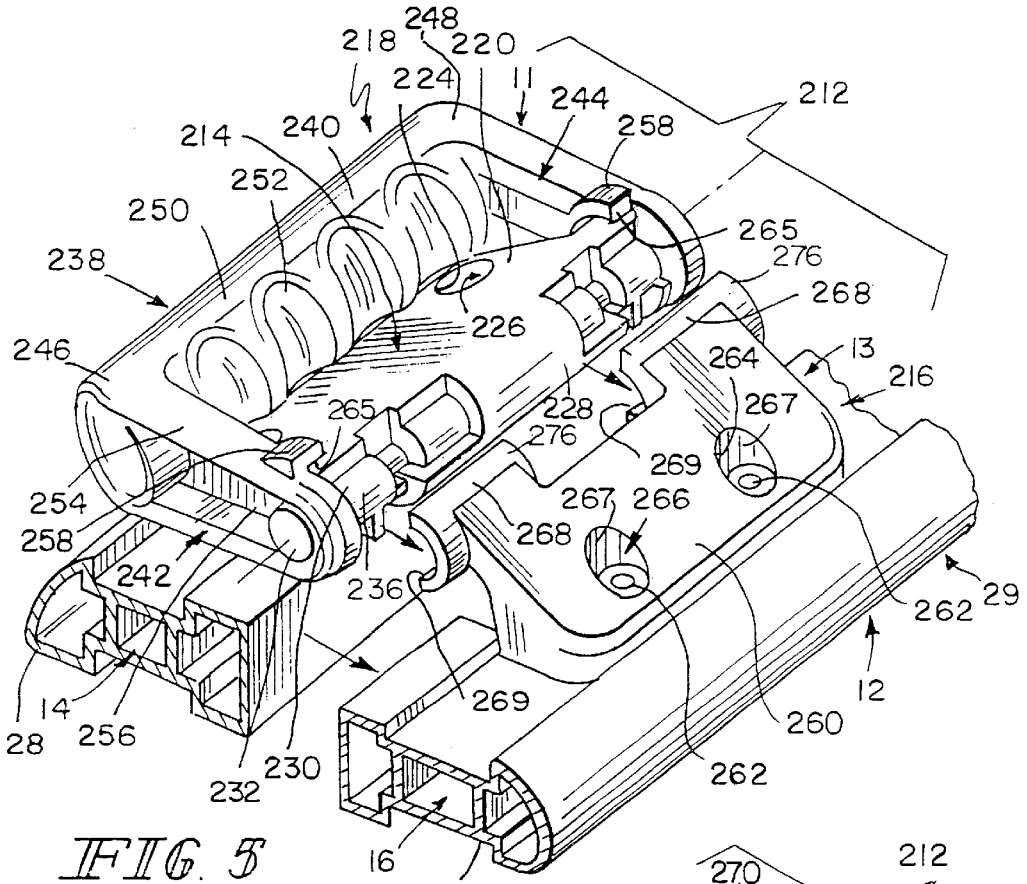
FIG. 5 is an enlarged perspective view of the carrier lock and handle anchor illustrated in FIGS. 1–4 wherein the handle anchor includes a pair of C-shaped rod jackets coupled to a jacket support mounted on a portion of the rear leg as shown on the right side of the drawing and the carrier lock includes a handle coupled for pivotable movement to a handle mount fixed on a portion of the front leg as shown on the left side of the drawing, the handle includes a handle grip and a pivot rod coupled to the handle grip and adapted to be mated with the two C-shaped rod jackets when the rear leg is moved to lie alongside the front leg as shown in FIG. 6, and the carrier lock further includes two "quarter-round" curved retainer members coupled to the handle grip.

Carrier lock 11 includes a handle 218 pivotably coupled to a handle mount 214 that is fixed to front leg 14 and a pair of retainer members 258 coupled to handle 218 as shown, for example, in FIG. 5. Retainer members 258 move in direction 272 in response to pivoting movement of handle 218 (in direction 270) about pivot axis 271 from an "out-of-the-way" position shown in FIGS. 5 and 6 to assume a "stool-carrying" position as shown in FIG. 7 to trap "rod jacket" portions 268 of handle anchor 216 between retainer members 258 and a pivot rod 230 included in handle 214.

By trapping rod jackets 268 between retainer members 258 and pivot rod 230 as shown in FIGS. 7 and 8, handle 218 is "locked" to handle anchor 216 to retain rear leg 16 in a fixed position alongside front leg 14 after step stool 10 has been folded for transport or storage. The legs 14, 16 can be "unlocked" easily by rotation of handle 218 about pivot axis 271 from either one of the positions shown in FIGS. 7 and 8 to the position shown in FIGS. 5 and 6. When step stool 10 is opened, handle 218 is moved away from handle anchor 216 as shown, for example, in FIGS. 1 and 4.

Figure 6:
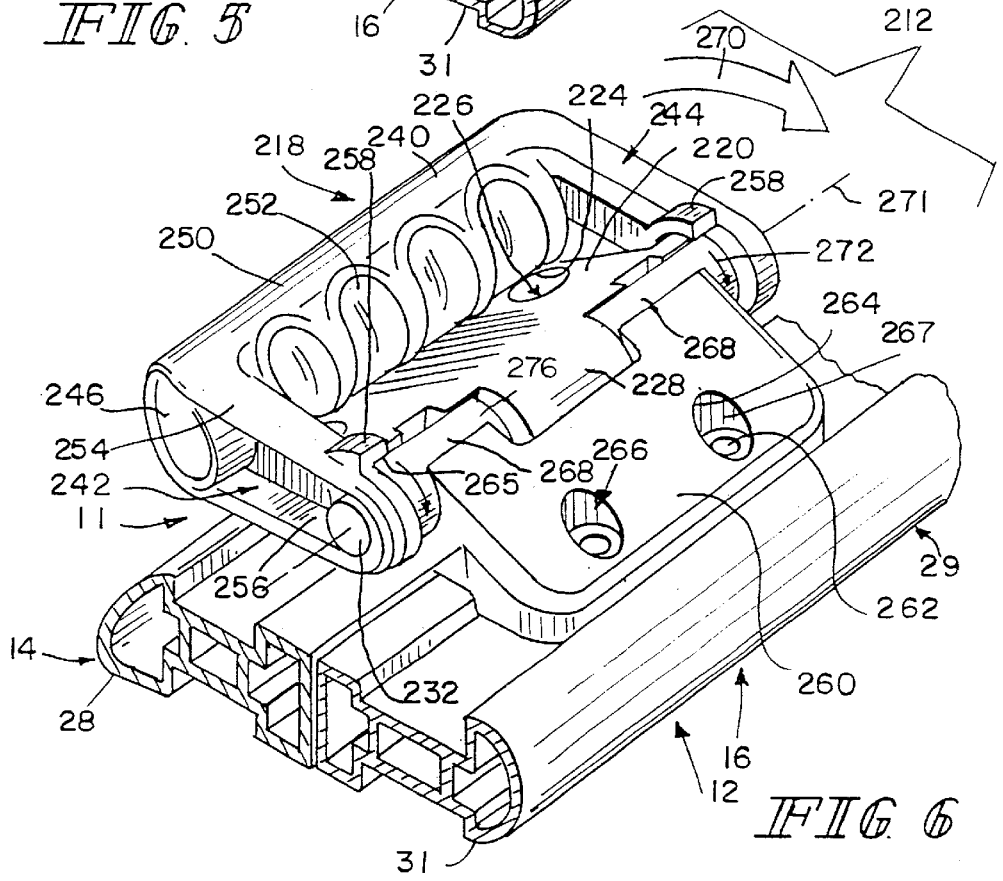
FIG. 6 is a view similar to FIG. 5 showing mating of the two C-shaped rod jackets of the handle anchor and the pivot rod of the handle prior to rotation of the handle grip (in the direction of the double arrow) to a position locking the front leg to the rear leg.

When step stool 10 is closed, handle 218 moves to mate with handle anchor 216 as suggested, for example, in FIGS. 5 and 6.

Figure 1:
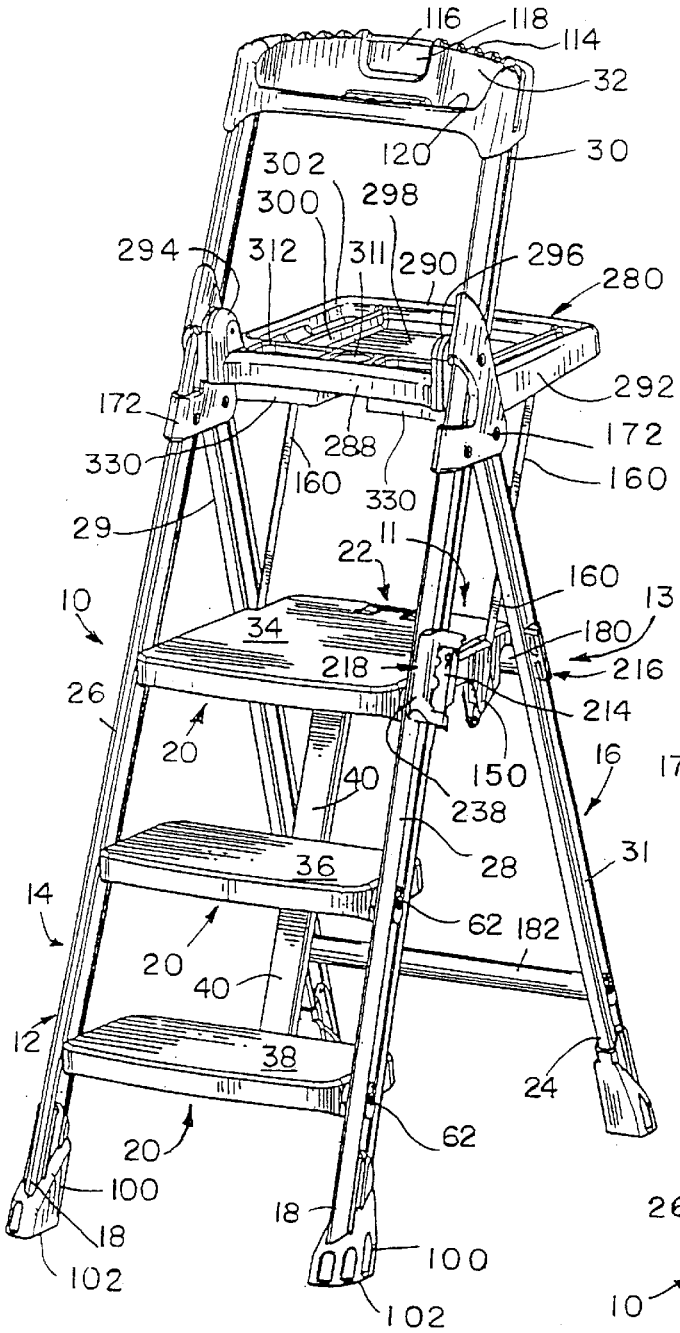
FIGS. 1–4 illustrate a step stool in accordance with the present invention, the step stool including a frame having front and rear legs arranged to lie in an opened use position and showing unmated portions of a leg lock and handle that are mounted on one side of the front and rear legs and configured to be mated as shown in FIGS. 5–7 to provide a side-mounted carrying handle that operates to lock the front leg to the rear leg when the step stool is folded to assume the closed storage position.

As shown in FIG. 1, step stool 10 includes a frame 12 having a front leg 14 and a rear leg 16, a set of steps 20 coupled to front leg 14, and a step latch 22 coupled to a top one of steps 20. Frame 12 of step stool 10 is foldable between an opened use position, shown in FIGS. 1 and 2, in which a bottom end 18 of front leg 14 is spaced-apart from a bottom end 24 of rear leg 16 and a closed or collapsed storage position, in which front and rear legs 14, 16 are folded together.

Frame 12 is converted easily between the use position and the storage position by lifting step latch 22 manually and moving set of steps 20 to a generally vertical position. As steps 20 are pivoted toward the generally vertical position, rear leg 16 pivots automatically toward front leg 14 causing step stool 10 to assume the collapsed, folded storage position.

As shown in FIG. 1, front leg 14 of frame 12 includes opposite leg members 26, 28 each including a bottom end 18 and an opposite top end 30. A top bar handle portion 32 extends between leg members 26, 28 and steps 20 are spaced-apart from one another between top bar 32 and bottom end 18 of front leg 14. Steps 20 include top step 34, middle step 36, and bottom step 38 coupled together by a link 40. While leg members 26, 28 are preferably constructed of extruded aluminum, it is understood that a wide variety of metallic and nonmetallic materials may be used.

Feet 100 are provided that are formed to extend over ends 18 of leg members 26, 28. Each foot 100 includes a base 102 configured to rest upon a generally flat surface (not shown).

Figure 2:
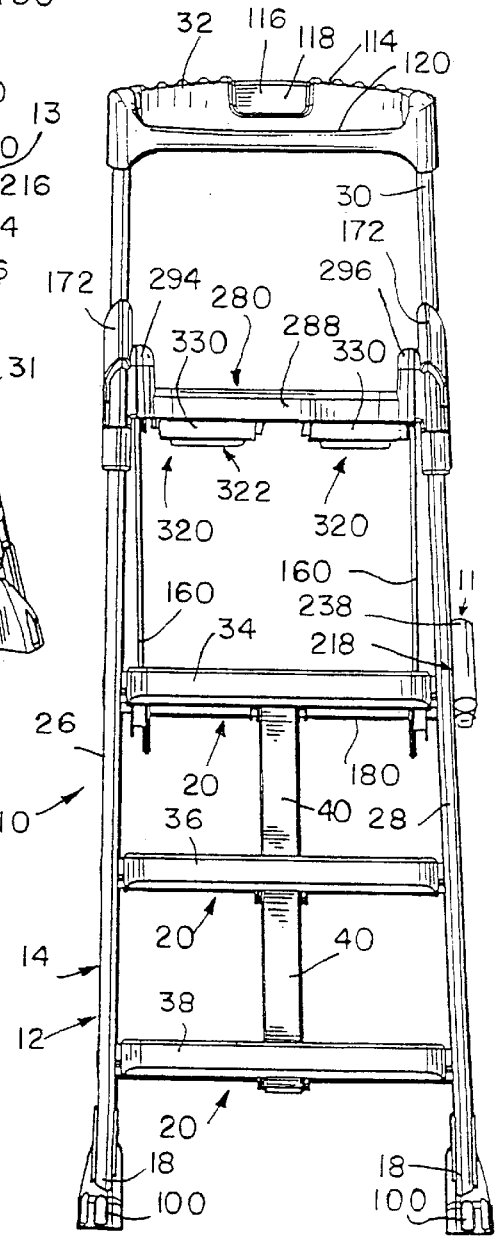
Figure 3:
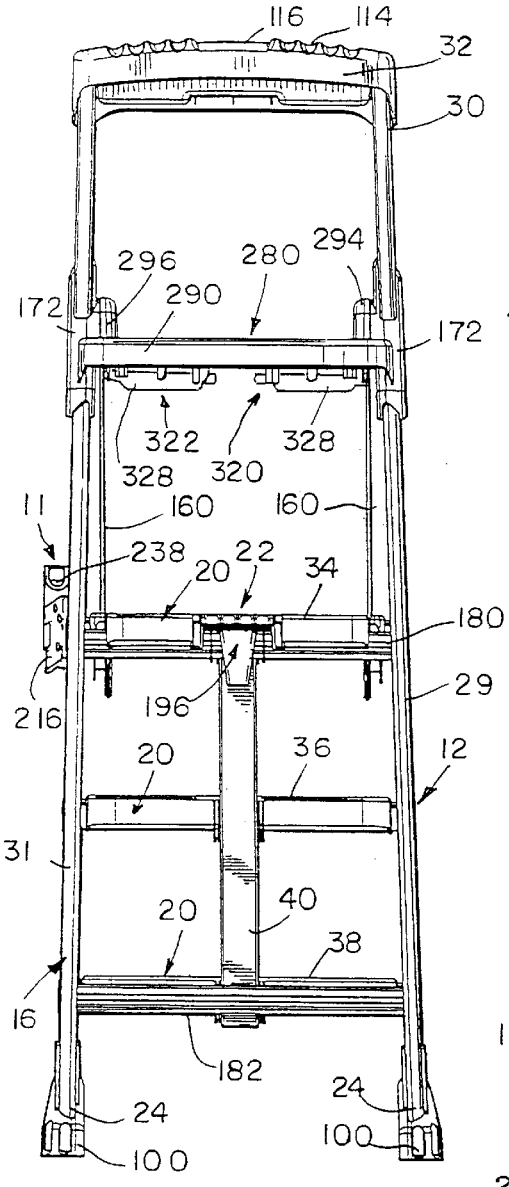

As shown in FIGS. 1 and 2, top bar 32 includes a top surface 114 extending between leg members 26, 28 and a hand grip 116 extending from top surface 114 to define a channel 118 sized to receive fingers (not shown) of a user gripping step stool 10. In addition, top bar 32 includes a shelf 120 spaced-apart from top surface 114 to receive miscellaneous items such as screws, nails, bolts, nuts, etc. It is within the scope of the present disclosure to form shelf 120 to include spaced-apart apertures or recesses (not shown) that are sized to receive tool shafts (not shown).

Figure 4:
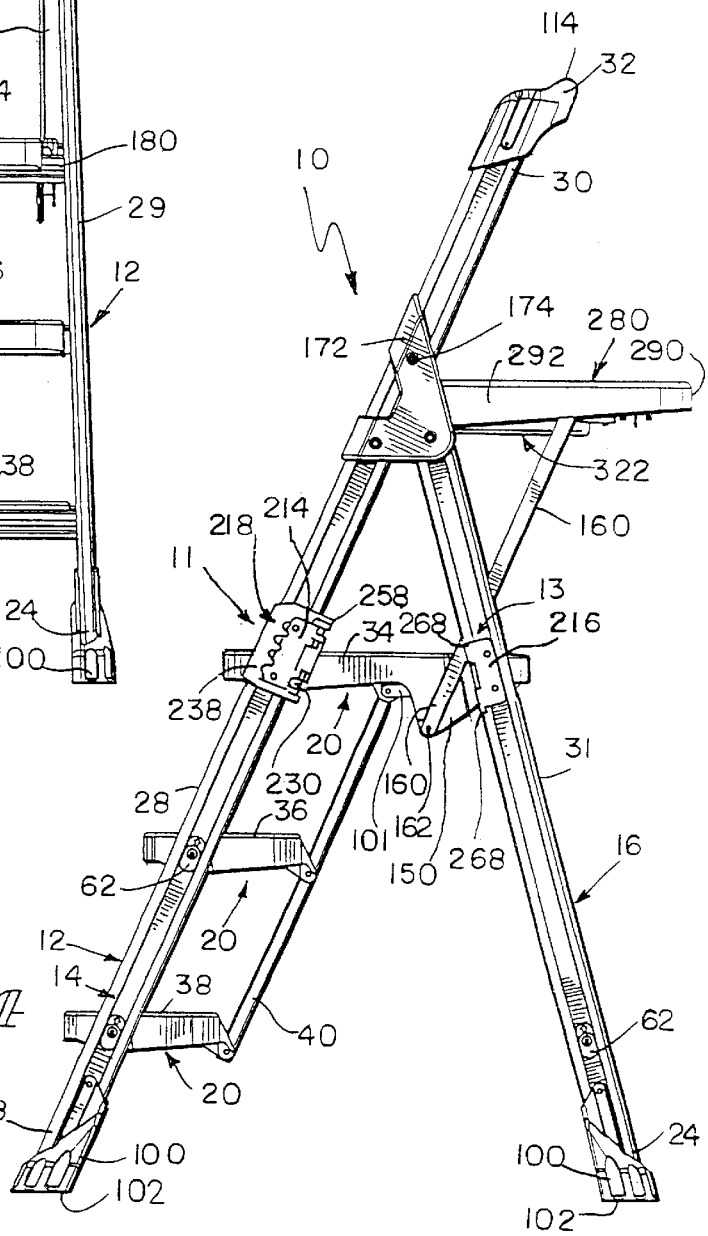

As shown in FIGS. 1–4, a pair of tray links 160 are provided in step stool 10 coupled at a lower end thereof by a pivot pin 162 to an apex of flange 150 (see FIG. 4). Each tray link 160 is further coupled at an upper end thereof to a flange of the utility tray to pivotably couple the tray and top step 34 together.

Rear leg 16 of frame 12 is coupled to front leg by a bracket 172, as shown in FIGS. 1–4. Bracket 172 lies adjacent to and is pivotably coupled to the utility tray. Bracket 172 further includes a pivot pin 174 to permit pivoting movement of rear leg 16 relative to front leg 14, although a wide variety of pins, rods, and the like may be used. Rear leg 16 includes first and second rear leg members 29, 31, upper cross strut 180, and a lower cross strut 182. Cross struts 180, 182 extend between and are coupled to rear leg members 29, 31.

Referring now to FIGS. 4 and 5, step stool 10 further includes a side-mounted, hand-tote latch 212 having a handle mount 214 coupled to leg member 28 of front leg 14, a handle anchor 216 coupled to leg member 31 of rear leg 16, and a handle 218 pivotally coupled to handle mount 214. When step stool 10 is in the storage position, handle 218 is formed to couple with handle anchor 216 in order to form hand-tote latch 212, as shown in FIG. 7. Hand-tote latch 212 is then positioned for use by user so that step stool 10 may be carried by hand-tote latch 212 to a storage area, for example, as described in detail herein.

Handle mount 214 is coupled to leg member 28 of front leg 14, as shown in FIGS. 1–8. Referring now to FIGS. 5 and 8, handle mount 214 is formed to include a base 220 and two fasteners 222 which are shown in FIG. 8. Base 220 is formed to include a pair of rims 224 forming recessed apertures 226 each having a side wall 227 formed therein. Base 220 is further formed to include a rod-receiving bearing 228 defining a cylindrical passageway (not shown) therethrough. Fasteners 222 are formed to be received within recessed apertures 226 of base 220 to be further received within apertures (not shown) formed within leg member 28 of front leg 14 in order to couple handle mount 214 rigidly to leg member 28.

Handle 218, as mentioned before, is coupled to handle mount 214 of hand-tote latch 212. Handle 218 includes a handle grip 238 and a pivot rod 230 having a first end 232, an opposite end (not shown), and a cylinder-shaped middle portion 236 therebetween. Pivot rod 230 is formed to be received within the passageway formed in rod-receiving bearing 228 of base 220 so that middle portion 236 and rod-receiving bearing 228 are positioned to engage one another. Pivot rod 230 is pivotably movable within the passageway and relative to handle mount 214 about a pivot axis 271.

Handle grip 238 is coupled rigidly to pivot rod 230 at first and second ends 232, 234 of pivot rod 230. Handle grip 238 is formed to include grip portion 240, a first arm or grip support 242 coupled to grip portion 240 and first end 232 of pivot rod 230, and a second arm or grip support 244 positioned to lie in spaced-apart relation to first arm 242 and coupled to grip portion 240 and second end 234 of pivot rod 230. Grip portion 240 is firther formed to include a first end 246, a second end 248, and a textured member 250 having indentations 252.

Each of the first and second arms 242, 244 of handle grip 238 are formed to include a distal end 254 coupled to respective first and second ends 246, 248 of the grip portion of handle grip 238 and a proximal end 256 rigidly coupled to respective first and second ends 232, 234 of pivot rod 230. Each proximal end 256 of first and second arms 242, 244 is formed to include an aperture (not shown) for receiving each respective first and second end 232, 234 of pivot rod 230 therein. Handle 218 further includes a pair of retainer members 258 coupled to first and second arms 242, 244. Each retainer member 258 is a "quarter-round" flange forming a partial arc shape and is positioned to extend out from each proximal end 256, as shown, for example, in FIGS. 5 and 6.

Handle anchor 216 is coupled to leg member 29 of rear leg 16 as shown in FIGS. 1–8. Referring now to FIG. 5, handle anchor 216 is formed to include a jacket support 260 and two fasteners 262 similar to the two fasteners 222 of handle mount 214. Jacket support 260 of handle anchor 216 is formed to include a pair of rims 264 forming recessed apertures 266, each having a side wall 267 formed therein. Fasteners 262 are formed to be received within recessed apertures 266 of jacket support 260 of handle anchor 216 to be further received within apertures (not shown) formed within leg member 31 of rear leg 16 in order to couple handle anchor 216 rigidly to leg member 31.

Handle anchor 216 is further formed to include a pair of C-shaped rod jackets 268 coupled to jacket support 260 and formed to partially receive middle portion 236 of pivot rod 230 therein, as shown in FIGS. 6–8. Each rod jacket 268 is formed to include a concave inner surface 269 defining a channel receiving a portion of the pivot rod 230 therein when rear leg 16 is locked to front leg 14 as shown, for example, in FIGS. 5 and 6.

In operation, handle anchor 216, coupled to rear leg 16, is positioned to lie in spaced-apart relation to handle mount 214 which is coupled to front leg 14 and to handle 218 when step stool 10 is in the opened, use position, as shown in FIGS. 1 and 4. When step stool 10 is in the closed, storage position, rear leg 16 and front leg 14 are positioned to lie alongside one another, as shown, for example, in FIG. 6. C-shaped rod jackets 268 are positioned to lie in spaced-apart relation to one another so that once step stool 10 is in the closed position and C-shaped rod jackets 268 are positioned to engage middle portion 236 of pivot rod 230, rod-receiving bearing 228 of handle mount 214 is positioned to lie between each C-shaped rod jacket 268 of handle mount 216.

To lock leg member 28 of front leg 14 to leg member 31 of rear leg 16, hand-tote latch 212 is "secured" by rotating handle 218 in direction 270 about a pivot axis 271, as shown in FIG. 6. In order to rotate handle 218, a user grasps grip portion 240 of handle grip 238 and rotates grip portion 240 in direction 270. Handle grip 238 and pivot rod 230 are united to rotate in unison with one another. As further noted by arrows 272 shown in FIG. 6, retainer members 258 coupled to proximal end 256 of first and second arms 242, 244 are also urged to rotate about pivot axis 271 so that each retainer member 258 is positioned to lie above and thus trap each respective C-shaped rod jacket 268, as shown in FIG. 7, so that a portion of each C-shaped rod jacket 268 is trapped between the ends of retainer member 258. Each rod jacket 268 has a convex outer surface 276 configured to mate with a curved inner surface 265 of its companion retainer member 258 as shown, for example, in FIGS. 5 and 6. Once each retainer member 258 is positioned to trap each respective C-shaped rod jacket 268, hand-tote latch 212 is in a "locked" position and front leg 14 is thus "locked" to rear leg 16.

As shown in FIG. 7, handle 218 is placed in a stool-carrying, upright position in order to secure hand-tote latch 212. When handle 218 is in the upright position, a user may grasp grip portion 240 to carry step stool 10 to a storage area, for example. When step stool 10 is being stored, handle 218 may be further rotated in direction 270 so that grip portion 240 of handle 218 is positioned to lie adjacent leg member 31 of rear leg 16, as shown in FIG. 8. When handle 218 is positioned to lie adjacent to leg member 31, grip portion 240 is generally out of the way and step stool 10 is ready for storage.

Figure 9:
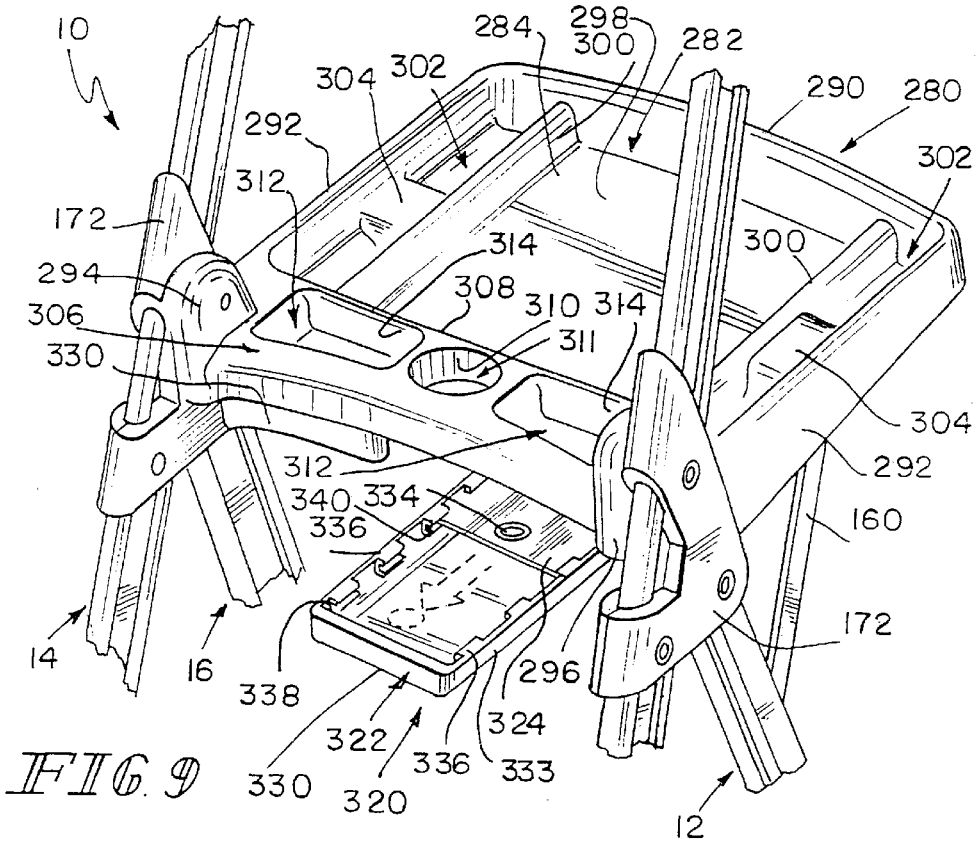
FIG. 9 is a perspective view of the tray of the step stool of FIGS. 1–4 showing the tray having two drawers and further showing one of the drawers of the tray extended in an opened position and also showing features of the tray such as the tray surface and tray compartments.
Figure 10:
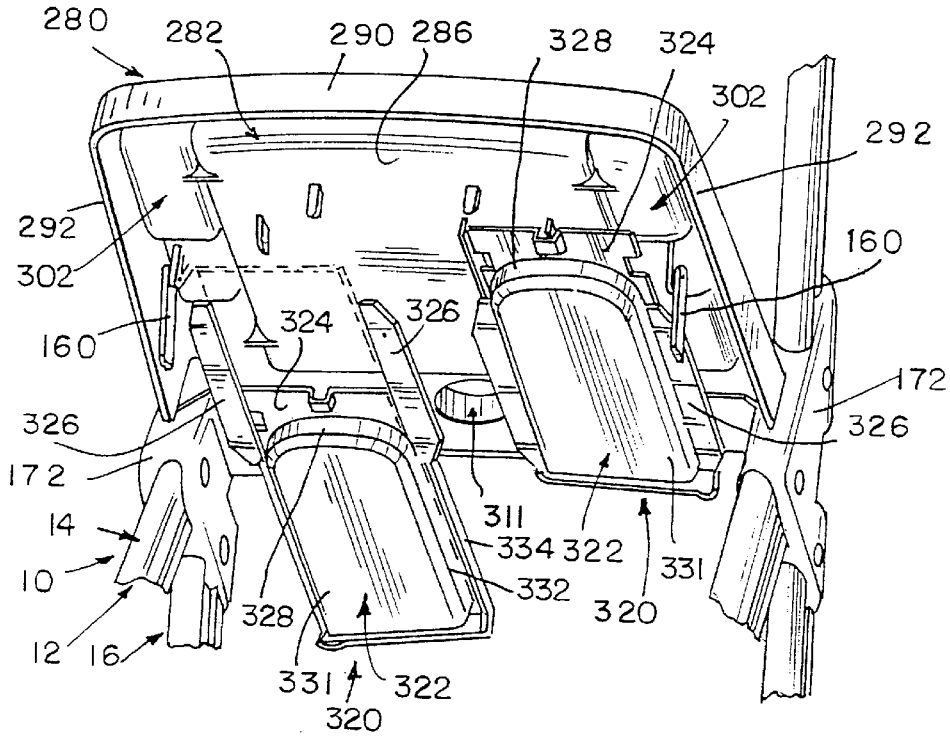
FIG. 10 is a perspective view of the tray of FIG. 9 showing a bottom portion of the tray and showing the drawers of the tray coupled to a bottom surface of the tray.

In addition to hand-tote latch 212, step stool 10 is further formed to include tray 280, as shown in FIGS. 9 and 10. Tray 280 is formed to include a palate 282 having a top surface 284, a bottom surface 286, a front wall 288, a rear wall 290, and two side walls 292 each positioned to extend between front wall 288 and rear wall 290. Front wall 288, rear wall 290, and each side wall 292 are coupled to and positioned to extend from top surface 284. Tray 280 is further formed to include a first mount 294 and a second mount 296 coupled to top surface 284 and front wall 288 so that front wall 288 is positioned to lie between each of the first and second mounts 294, 296. First and second mounts 294, 296 are each coupled to respective brackets 172, as shown in FIG. 9.

Tray 280 is formed to include many structural features. For example, top and bottom surfaces 284, 286 cooperate to define a flat portion 298 of palate 282 further defined by and positioned to lie between ridges 300. Each side wall 292, ridge 300, and a portion of rear wall 290 are formed to define compartments 302 separated from each other by dividers 304, as shown in FIG. 9. Palate 282 is further formed to include a cross-bar 306 defined by front wall 288, a portion of top surface 284, and inner wall 308. Cross-bar 306 is formed to include a circular rim 310 defining an aperture 311 formed to extend through cross bar 306. Cross-bar 306 is further formed to include two additional compartments 312 defined by walls 314, as shown in FIG. 9.

Referring now to FIG. 10, tray 280 is further formed to include two drawers 320 slidably coupled to bottom surface 286 of palate 282. Each drawer 320 is formed to include a container 322, a lid 324 formed to cover container 322, and a pair of side brackets 326. Each pair of side brackets 326 is coupled to bottom surface 286 of palate 282 and positioned to lie in spaced-apart relation to each other.

Each container 322 is defined by a rear wall 328, a front wall 330, a bottom 331, and side walls 332 positioned to lie in spaced-apart relation to one another and coupled to each of the front wall 330, rear wall 328, and bottom 331. Each container 322 is further formed to include an outer rim 333 extending about front wall 330 and side walls 332, as shown in FIGS. 9 and 10.

Each lid 324 of each drawer 320 is formed to define a grip 334 in order to allow a user to open and close lid 324 relative to container 322. Each container 322 is further formed to include multiple C-shaped brackets 336 coupled to an inner surface 338 of each side wall 332, as shown in FIG. 9. Each C-shaped bracket 336 defines a channel 340 formed to receive lid 324 therein.

Although the invention has been described in detail with reference to certain preferred embodiments, variations and modifications exist within the scope and spirit of the invention as described and defined in the following claims.

What is claimed is:

1. A step stool comprising a frame including a front leg and a rear leg coupled to the front leg for movement relative to the front leg, a handle supported for pivotable movement on the front leg about a pivot rod, and a retainer coupled to the handle to move therewith about the pivot rod and arranged to clampingly trap a portion of the rear leg between the rod and the retainer upon movement of the handle to a predetermined position relative to the rear leg to lock the front leg to the rear leg.

2. The step stool of claim 1, wherein the rear leg includes a leg member and a handle anchor coupled to the leg member and configured to include the portion of the rear leg trapped between the rod and the retainer.

3. The step stool of claim 2, wherein the pivot rod is supported to rotate about a pivot axis and a handle grip coupled to the pivot rod to rotate therewith and the portion of the rear leg is a rod jacket formed to include a concave inner surface defining a channel receiving a portion of the pivot rod therein when the rear leg is locked to the front leg.

4. The step stool of claim 3, wherein the handle anchor further includes a jacket support coupled to the leg member and arranged to support the rod jacket in spaced-apart relation to the leg member and in confronting relation to the portion of the pivot rod upon movement of the rear leg to a position alongside the front leg.

5. The step stool of claim 3, wherein the portion of the pivot rod is cylinder-shaped, the rod jacket is a C-shaped member having a convex outer surface, and the retainer includes a curved inner surface configured to mate with the convex outer surface of the rod jacket.

6. The step stool of claim 3, wherein the handle grip includes a grip portion arranged to lie in spaced-apart parallel relation to the pivot rod and a pair of grip supports coupled to the grip portion and the pivot rod to maintain the grip portion in a fixed position relative to the pivot rod, and the retainer is coupled to at least one of the grip supports and arranged to define a space located between the retainer and the pivot rod adapted to receive the rod jacket therein upon movement of the handle relative to the rear leg to the predetermined position.

7. The step stool of claim 1, wherein the handle includes a pivot rod supported to rotate about a pivot axis and a handle grip coupled to the pivot rod to rotate therewith and the retainer is coupled to the handle grip and arranged to define a space between the retainer and the pivot rod adapted to receive the portion of the rear leg therein upon movement of the handle relative to the rear leg to the predetermined position.

8. The step stool of claim 7, wherein the pivot rod includes a cylinder-shaped portion, the portion of the rear leg is a C-shaped member including a concave inner surface shaped to mate with the cylinder-shaped portion of the pivot rod and a convex outer surface, and the retainer includes a curved inner surface shaped to mate with the convex outer surface of the C-shaped member.

9. The step stool of claim 7, wherein the rear leg includes a leg member and a handle anchor coupled to the leg member and configured to include the portion of the rear leg trapped between the handle and the retainer.

10. The step stool of claim 1, wherein the rod has a curved exterior surface and the portion of the rear leg is a rod jacket formed to include a concave inner surface defining a channel receiving the curved exterior surface of the rod therein when the rear leg is locked to the front leg.

11. The step stool of claim 10, wherein the rod jacket is a C-shaped member having a convex outer surface and the retainer includes a curved inner surface configured to mate with the convex outer surface of the rod jacket.

12. The step stool of claim 10, wherein the handle further includes a grip portion adapted to be gripped by a person and a grip support arranged to interconnect the grip portion and the rod and the retainer is coupled to the grip support and arranged to define a space located between the retainer and the rod and adapted to receive the rod jacket therein upon movement of the handle relative to the rear leg to the predetermined position.

13. A step stool comprising a frame including a front leg and a rear leg coupled to the front leg for movement relative to the front leg, a handle, a handle mount coupled to the front leg and arranged to support the handle for pivotable movement about a pivot rod, a handle anchor coupled to the rear leg and arranged to mate with the handle upon movement of the rear leg to lie alongside the front leg, and a retainer coupled to the handle to move therewith about the pivot rod and arranged to clampingly trap a portion of the handle anchor between the rod and the retainer upon movement of the handle about the pivot axis to assume a stool-carrying position when the handle anchor is mated to the handle.

14. The step stool of claim 13, wherein the pivot rod is coupled to the handle mount to rotate about a pivot axis and a handle grip coupled to the pivot rod to rotate therewith and the retainer is coupled to the handle grip to rotate therewith.

15. The step stool of claim 14, wherein the retainer is positioned to lie in spaced-apart relation to the pivot rod to define a space therebetween and the portion of the handle anchor is positioned to lie in the space upon movement of the handle about a pivot axis to assume a stool-carrying position when the handle anchor is mated to the handle.

16. The step stool of claim 15, wherein the pivot rod includes a cylinder-shaped portion, the portion of the handle anchor is a C-shaped member including a concave inner surface shaped to mate with the cylinder-shaped portion of the pivot rod and a convex outer surface, and the retainer includes a curved inner surface shaped to mate with the convex outer surface of the C-shaped member.

17. The step stool of claim 13, wherein the handle mount includes a base coupled to the front leg and a bearing coupled to the base and formed to include a passageway therein, the handle includes the pivot rod arranged to extend through the passageway and to rotate about a pivot axis and a handle grip coupled to the pivot rod to rotate therewith, and the retainer is coupled to the handle grip to move therewith about the pivot axis.

18. The step stool of claim 17, wherein the portion of the handle anchor is defined by a pair of rod jackets, each rod jacket is formed to include a concave inner surface defining a channel receiving a portion of the pivot rod therein when the rear leg is locked to the front leg, and the rod jackets are arranged to lie in spaced-apart relation to one another to receive the bearing therebetween when the rear leg is locked to the front leg.

19. The step stool of claim 18, wherein the handle grip includes a grip portion arranged to lie in spaced-apart parallel relation to the pivot rod and a pair of grip supports coupled to the grip portion and the pivot rod to maintain the grip portion in a fixed position relative to the pivot rod and the retainer includes a first retainer member coupled to a first of the grip supports and arranged to trap one of the rod jackets between the first retainer member and one portion of the pivot rod upon movement of the handle about the pivot axis to assume the stool-carrying position when the handle anchor is mated to the handle and a second retainer member coupled to a second of the grip supports and arranged to trap another of the rod jackets between the second retainer member and another portion of the pivot rod upon movement of the handle about the pivot axis to assume the stool-carrying position when the handle anchor is mated to the handle.

20. The step stool of claim 17, wherein the portion of the handle anchor is a rod jacket formed to include a concave inner surface defining a channel receiving a portion of the pivot rod therein when the handle anchor is mated to the handle.

21. The step stool of claim 20, wherein the portion of the pivot rod is positioned to lie between the base and the rod jacket and the rod jacket is positioned to lie between the handle grip and the bearing when the handle anchor is mated to the handle.

22. A step stool comprising a frame including a front leg and a rear leg coupled to the front leg for movement relative to the front leg, the front leg including a longitudinal leg coupled to the rear leg and adapted for engagement with a foundation, a handle coupled to the front leg for pivotable movement about a pivot axis that is parallel to a longitudinal axis of the longitudinal leg, and a portion of the handle including locking means for locking the rear leg to the handle when the rear leg is positioned to lie alongside the front leg in response to movement of the handle relative to the front leg to retain the rear leg in a fixed position alongside the front leg.

23. The step stool of claim 22, wherein the locking means includes a handle anchor coupled to the rear leg and a retainer coupled to the handle.

24. The step stool of claim 23, wherein the handle includes a pivot rod supported for rotation on the front leg about a pivot axis and a handle grip coupled to the pivot rod to rotate therewith and the retainer is coupled to the handle grip to move therewith about the pivot axis and arranged to trap a portion of the handle anchor between the pivot rod and the retainer upon movement of the handle about the pivot axis to assume a stool-carring position when the rear leg lies in the fixed position alongside the front leg.

25. The step stool of claim 23, wherein the handle includes a pivot rod supported for rotation on the front leg, a grip portion arranged to lie in spaced-apart parallel relation to the pivot rod, and a pair of grip supports coupled to the grip portion and the pivot rod to maintain the grip portion in a fixed position relative to the pivot rod, and the retainer is coupled to at least one of the grip supports.

26. The step stool of claim 23, wherein the handle includes a pivot rod supported for pivotable movement on the front leg about a pivot axis, the handle anchor includes a rod jacket configured to mate with the pivot rod when the rear leg lies in the fixed position alongside the front leg, and the retainer is arranged to trap the rod jacket between a portion of the pivot rod and the retainer upon movement of the handle about the pivot axis to assume a stool-carrying position when the rear leg lies in the fixed position alongside the front leg.

27. The step stool of claim 26, wherein the portion of the pivot rod is cylinder-shaped, the rod jacket is a C-shaped member having a convex outer surface, and the retainer includes a curved inner surface configured to mate with the convex outer surface of the rod jacket.

28. The step stool of claim 22, wherein a portion of the locking means is located on the handle.

29. A step stool comprising a frame including a front leg and a rear leg movable relative to the front leg between an opened, use position and a closed, storage position, the front leg extending longitudinally and coupled to the rear leg, a handle supported for pivotable movement on one of the legs about a pivot axis that is parallel to a longitudinal axis of the front leg and a retainer carried by the handle to move with the handle about the pivot axis to lock the front leg to the rear leg in the collapsed, storage position so that the step stool can be carried using the handle.

30. The step stool of claim 29, wherein the handle includes a handle grip and a pivot rod that is coupled to the handle grip and defines the pivot axis and the retainer is coupled to the handle grip to move with the handle grip as the handle grip pivots about the pivot axis.

31. The step stool of claim 30, wherein the rear leg includes a handle anchor formed to include a channel sized to receive the pivot rod therein and the retainer is configured to block movement of the handle anchor away from the pivot rod in response to movement of the handle grip about the pivot axis when the front and rear legs are in the collapsed, storage position.

* * * * *